United States Patent [19]

Watanabe

[11] Patent Number: 4,696,564

[45] Date of Patent: Sep. 29, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 883,728

[22] Filed: Jul. 9, 1986

[30] Foreign Application Priority Data

Jul. 11, 1985 [JP] Japan ..... 60-153068
Aug. 16, 1985 [JP] Japan ..... 60-180214

[51] Int. Cl.[4] ..... G03G 15/00

[52] U.S. Cl. ..... 355/14 R; 355/3 R; 355/3 SH; 355/8

[58] Field of Search ..... 355/14 R, 14 SH, 8, 355/3 R, 3 SH, 55, 56, 7

[56] References Cited

U.S. PATENT DOCUMENTS 4,571,055 2/1986 Nishiyama ..... 355/3 SH
4,571,067 2/1986 Nishiyama ..... 355/3 SH X
4,572,650 2/1986 Okuda ..... 355/3 SH
4,589,759 5/1986 Fantuzzo et al. ..... 355/3 SH X
4,589,765 5/1986 Perun et al. ..... 355/3 SH
4,626,924 12/1986 Watanabe ..... 355/14 SH X
4,634,260 1/1987 Watanabe ..... 355/7

*Primary Examiner*—A. C. Prescott
*Attorney, Agent, or Firm*—Cushman, Darby & Cushman

[57] ABSTRACT

An image forming apparatus includes an optical detection unit which detects the presence of a copy paper and determines an offset amount of the copy paper in the direction perpendicular to a feeding direction of the copy paper. An adjusting unit adjusts a position of a visible image, in the direction perpendicular to the feeding direction of the copy paper, formed on the copy paper by a visible image forming unit on the basis of the determination of the detection unit. The image forming apparatus may also include a comparing circuit which compares an actual feeding time interval of the copy paper between an aligning roller pair and the detection unit with a prescribed feeding time interval and determines a discrepancy therebetween and a control circuit controlling a commencement timing of the operation of a scan member on the basis of the result of the comparing circuit, thus enabling the image forming apparatus to adjust a position of the visible image, in the feeding direction of the copy paper, formed on the copy paper.

20 Claims, 16 Drawing Figures

IMAGE FORMING APPARATUS

BACKGROUND OF THE INVENTION

1. Field of the invention

The present invention relates, in general, to image forming apparatus. More specifically, the invention relates to an electrostatic copying machine which forms a visible image corresponding to an original document on a paper.

2. Description of the prior art

Generally, in conventional copying machines, a copy paper may be offset in the direction perpendicular to the feeding direction of a copy paper, as it is fed from a paper-cassette to a photosensitive drum. This offset results from the manual setting of the paper-cassette by an operator. Since the offset is limited to 3 nm in either direction from the optimum, it has been neglected in conventional copying machines. However, the shifting of the paper causes an offset of a visible image of an original document formed on a copy paper.

Furthermore, since qualities of copy paper vary widely, such as e.g., sheet thickness, smoothness, etc., the actual feeding time interval for feeding a copy paper from a pair of aligning rollers to a photosensitive drum may vary from a prescribed feeding time interval. This is caused by slipping between the copy paper and the aligning roller pair. The result is that it is difficult to form the visible image of an original document at an appropriate position on the copy paper.

It is, therefore, desirable to detect the above-described offset and feeding time interval variations of the copy paper and to adjust the position of the visible image formed on the copy paper. Furthermore, it is convenient to achieve such adjustment even though the size of a copy paper is changed.

SUMMARY OF THE INVENTION

It is an object of the present invention to provide an improved image forming apparatus which may form a visible image of an original document at an appropriate position on a copy paper.

To achieve the above object, an image forming apparatus includes a detection unit composed of a light-emitting element and photosensitive device for detecting the presence of a copy paper and determining an offset amount of the copy paper in the direction perpendicular to a feeding direction of the copy paper. A scan member optically scans an original document, and a corresponding visible image is formed on the copy paper. A first adjusting unit adjusts a position of the visible image, in the direction perpendicular to a feeding direction of the copy paper, formed on the copy paper on the basis of the determination of the detection unit.

A second adjusting unit may also be included having a counting circuit for counting pulses fed to a roller drive pulse motor which drives a pair of aligning rollers. Pulses are counted from the beginning of rotation of the aligning roller pair until the detection unit detects the presence of the copy paper. A comparing circuit compares the value produced by the counting circuit with a value of a prescribed feeding interval of the copy paper fed from the aligning roller pair to the detection unit and determines a discrepancy between an actual feeding time interval of the copy paper and a prescribed feeding time interval. A controlling circuit controls the timing of the operation of the scan member on the basis of the result of the comparing circuit. Thus, the image forming apparatus may adjust a position of the visible image, in the feeding direction of the copy paper, formed on the copy paper.

BRIEF DESCRIPTION OF THE DRAWINGS

These and other objects and advantages of this invention will become more apparent and more readily appreciated from the following detailed description of the presently preferred exemplary embodiments of the invention, taken in conjunction with the accompanying drawings, wherein like reference numerals throughout the various figures denote like structure elements and wherein:

FIGS. 8(*b*) and 8(*c*) are plan views illustrating how an offset of a copy paper is detected by the optical detection unit shown in FIG. 8(*a*);

FIGS. 11(*b*) and 11(*c*) are plan views showing how an offset of a copy paper is detected by an optical detection unit shown in FIG. 11(*a*).

DETAILED DESCRIPTION OF THE PREFERRED EXEMPLARY EMBODIMENTS

Preferred embodiments of the present invention will now be described in more detail with reference to the accompanying drawings.

Figure 1:
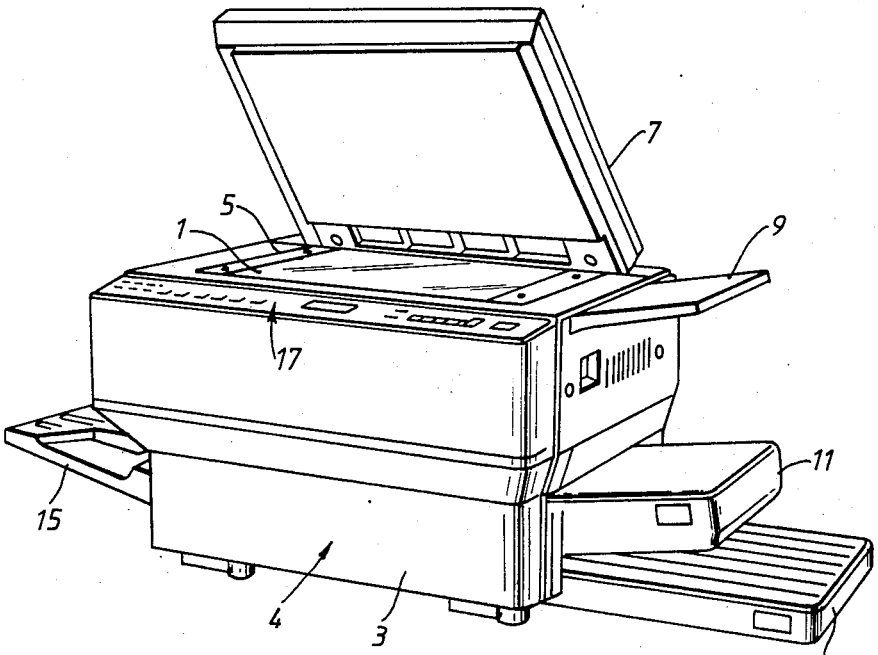
FIG. 1 is a perspective view illustrating the outer appearance of a first embodiment of an image forming apparatus according to the present invention.
Figure 2:
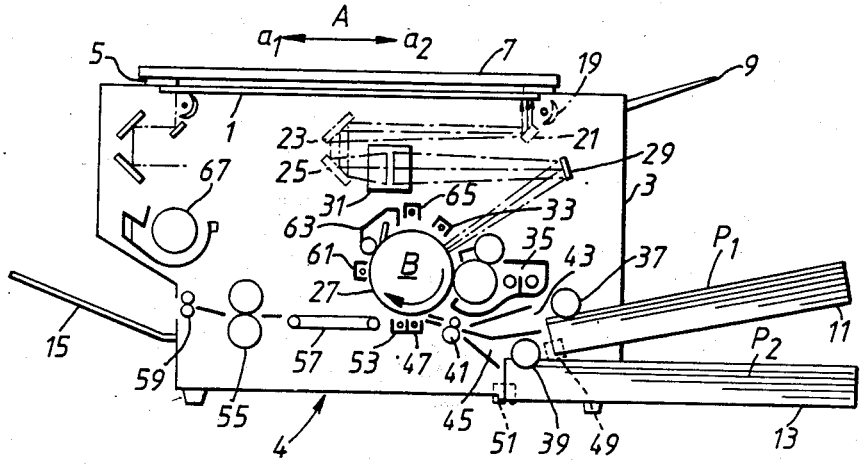
FIG. 2 is a schematic view illustrating a cross section of the image forming apparatus shown in FIG. 1.

FIGS. 1 and 2 illustrate one embodiment of the image forming apparatus, i.e., copying machine, of the present invention. A transparent document table 1, made of glass, is mounted on the top of a body 3 of a copy machine 4. A fixed scale plate 5 having set-reference marks is provided at the left side of document table 1. A document cover 7 which covers document table 1 is hinged at the back side of body 3. A work table 9 where documents to be copied may be temporally placed is provided to the right side of the upper portion of body 3.

Upper and lower cassettes 11 and 13, containing copy sheets of different sizes ($P_1$ and $P_2$) are removably inserted into the right lower portion of body 3. A tray 15 is removably attached to the left lower portion of body 3. A control panel 17 is arranged on the upper surface of body 3 at the front.

As can be seen in FIG. 2, a document (not shown) on document table 1 is illuminated by an optical unit including an exposure lamp 19 and mirrors 21, 23 and 25 when the optical unit moves in the directions $a_1$ and $a_2$ of arrow A. When exposure lamp 19 and mirror 21 move at speed V, mirrors 23 and 25 move at speed $\frac{1}{2}$ V so as to maintain a light path of a prescribed length. The light reflected from the document is guided to a photosensitive drum 27 by a mirror 29 through a magnification changing lens block 31. Thus, the image of an original document is focused on the surface of photosensitive drum 27. Photosensitive drum 27 is rotated in the direction of arrow B which is synchronized with the scanning operation of the optical unit.

Photosensitive drum 27 is charged with a positive charge by a charger 33. Then, photosensitive drum 27 is exposed to the light, in a slit light state, reflected from the document to create an electrostatic latent image of the document on the surface thereof. Toner, negatively charged by a developer 35 is applied to the electrostatic latent image to cause the latent image to become visible.

Then, either upper cassette 11 or lower cassette 13 is selected and the copy sheets $P_1$, for example, contained therein are taken out sheet-by-sheet by means of a roller 37. Each sheet is directed to a pair of aligning rollers 41 through a guide 43, thereby feeding each sheet between a transfer-charging device 47 and photosensitive drum 27. Cassette size sensors 49 and 51 are provided in insertion holes for cassettes 11 and 13. Cassettes size sensors 49 and 51 each contain a plurality of microswitches which are turned on and off in response to the size of the inserted cassette.

The copy sheet $P_1$ fed to the transfer part is in contact with photosensitive drum 27. Transfer-charging device 47 applies positive charges to the copy sheet $P_1$ and the toner image is transferred from photosensitive drum 27 onto the copy sheet $P_1$. The copy sheet $P_1$ with the transferred toner image is then separated from photosensitive drum 27 by a separation-charging device 53, and is transferred to a pair of fixing roller 55 by a transfer belt 57. Fixing roller pair 55 applies heat and pressure to the copy sheet $P_1$, thereby fixing the toner image. After fixing, the copy sheet $P_1$ is discharged onto tray 15 by a pair of discharge rollers 59.

Photosensitive drum 27, after it is subjected to the toner transfer process, reaches a charge remover 61. Charge remover 61 removes charges on photosensitive drum 27. Further, the residual toner on the surface of drum 27 is removed by a cleaner 63, and an after image (residual charges) is erased by a discharge lamp 65.

Thus, photosensitive drum 27 is returned to its initial state.

To prevent an excessive temperature rise in copy machine 4, a cooling fan 67 is provided above discharge roller pair 59.

Figure 3:
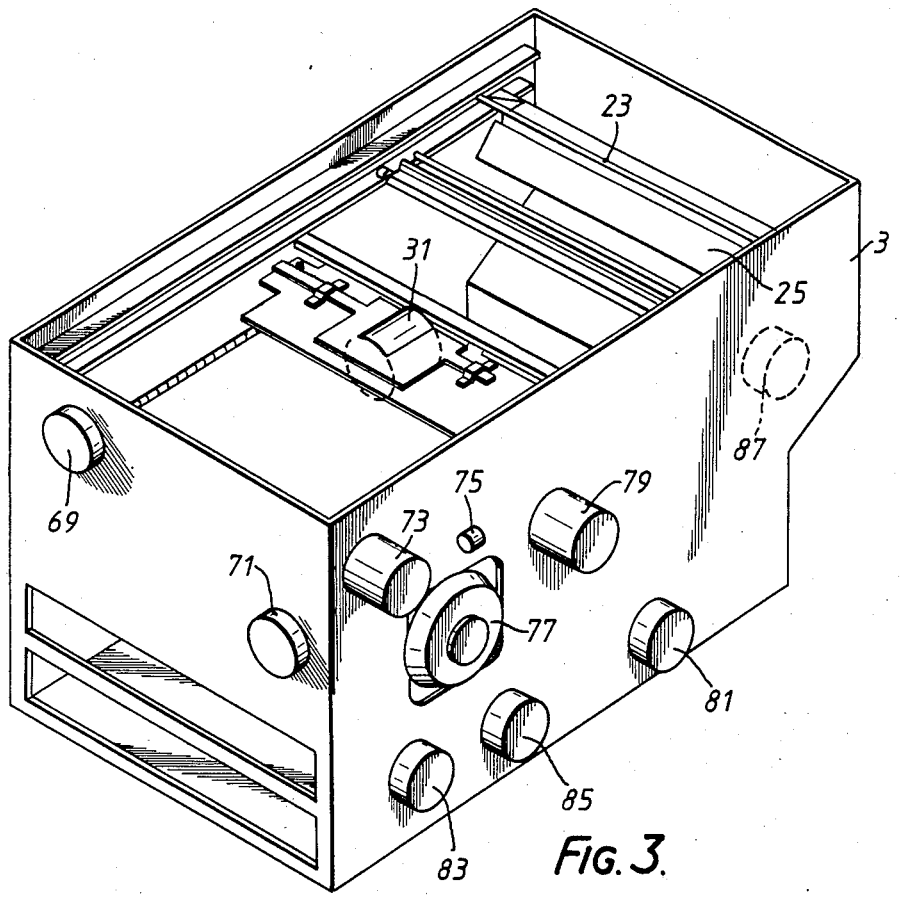
FIG. 3 is a perspective view illustrating how pulse motors as drive sources in the embodiment are allocated.

FIG. 3 shows an allocation of drive sources of copy machine 4 described above. The drawing of FIG. 3 is depicted as if viewed from the rear side of the copy machine 4, although FIG. 1 drawing shows the front side of the machine. A magnification changing motor 69 for changing the location of magnification changing block 31 is disposed at the left side of body 3. A mirror drive motor 71 also is disposed at the same side as motor 69. Mirror drive motor 71 changes the distance (optical path) between mirror 21 and mirrors 23 and 25 when the copy magnification is changed. A scanning motor 73 for moving exposure lamp 19 and mirrors 21, 23 and 25 to scan the document and a shutter motor 75 are disposed at the backside (front side shown in FIG. 3) of body 3. Shutter motor 75 moves a shutter (not shown) to adjust the charging width of the charge on photosensitive drum 27 which is charged by charger 33 when the copy magnification is changed. A developing motor 77 for driving the developing roller of developer 35, a drum motor 79 for driving photosensitive drum 27 and a fixing motor 81 are arranged at the backside of body 3. Fixing motor 81 drives transfer belt 57, fixing roller pair 55 and discharge roller pair 59. A paper supply motor 83 for driving feed rollers 37 and 39, a paper feed motor 85 for driving aligning roller pair 41 and a fan motor 87 for driving fan 67 also are arranged at the backside of body 3 of copy machine 4.

Figure 4:
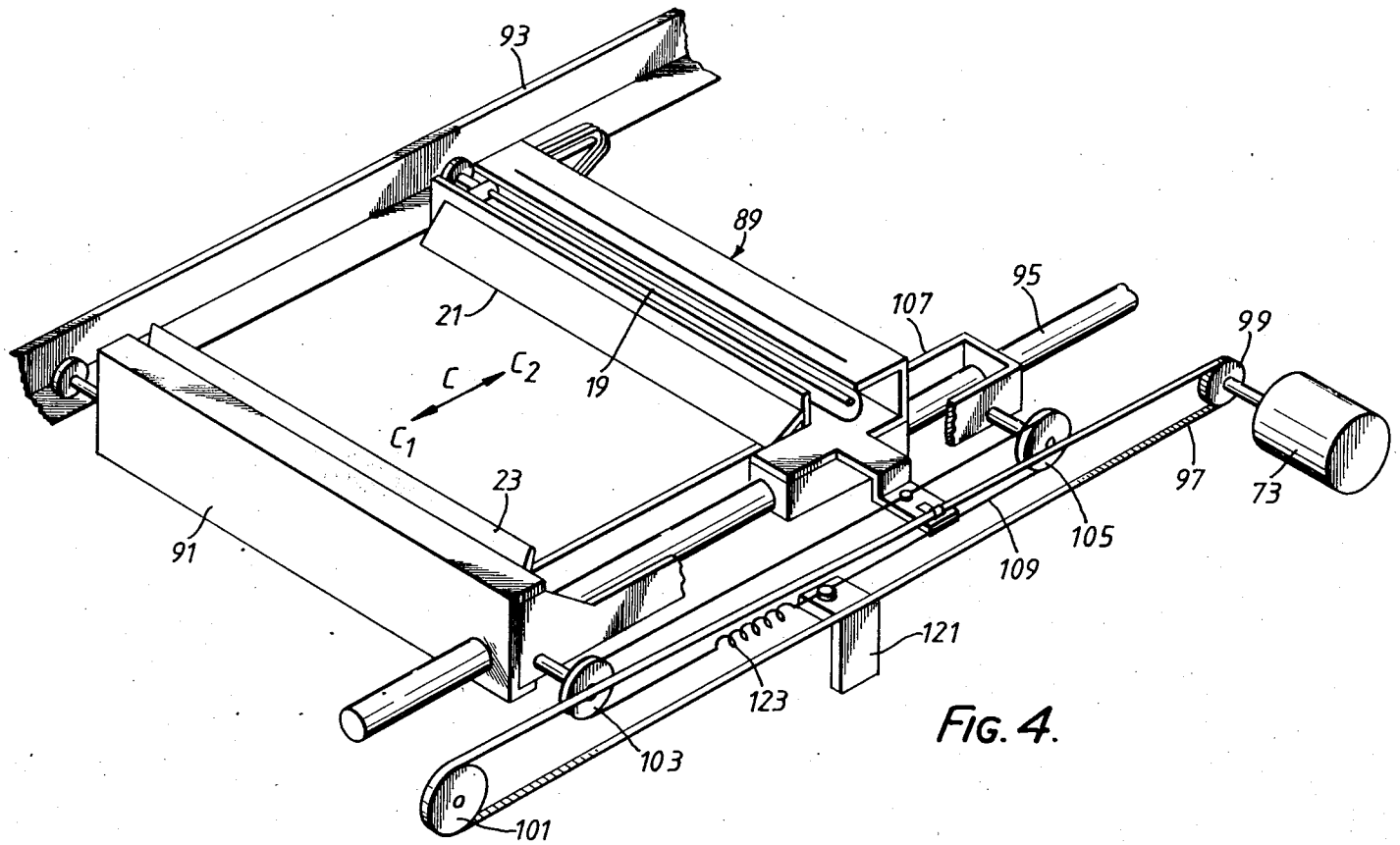
FIG. 4 is a perspective view of a scanning mechanism for moving an optical unit in the embodiment.

FIG. 4 shows a scanning mechanism for reciprocating the optical unit, composed of exposure lamp 19 and mirrors 21, 23 and 25, along document table 1. Mirror 21 and exposure lamp 19 are supported by a first carriage 89, and mirrors 23 and 25 by second carriage 91. These carriages 89 and 91 can move in the directions $c_1$ and $c_2$ of arrow C with guide rails 93 and 95. An endless belt 97 is wound between a pulley 99 which is driven by a 4-phase motor (scanning motor) 73 and an idle pulley 101. First carriage 89 is fixed at one end thereof to the mid-portion of endless belt 97. A couple of rotatable pulleys 103 and 105 are provided to the guide 107 of second carriage 91 in the state that pulleys 103 and 105 are apart from one another. A wire 109 is extended between these pulleys 103 and 105. One end of wire 109 is fixed to a fixed member 121, while the other end thereof is fixed to fixed member 121 through a coiled spring 123. One end of first carriage 89 is fixed to the mid-portion of wire 109. With the rotation of pulse motor 73, therefore, belt 97 rotates, thus causing first carriage 89 to move. Second carriage 91 also moves in association with the movement of first carriage 89. As pulleys 103 and 105 serve as a fall block, second carriage 91 moves at half of the speed of first carriage 89 while traveling in the same direction as first carriage 89. The moving direction of first and second carriages 89 and 91 can be changed by reversing the rotating direction of pulse motor 73.

First carriage 89 is moved to individual prescribed positions by rotation of motor 73 corresponding to the selection of paper size or magnification rate (enlargement/reduction rate). Each prescribed position is a "home" position corresponding to the magnification rate or the paper size selected. When the copy key (not shown) is pressed, first carriage 89 is moved toward second carriage 91, and then as it is in the left most position in FIG. 2, exposure lamp 19 comes on, whereupon first carriage 89 is moved from this position toward its original position. During this movement, the document on document table 1 is illuminated by exposure lamp 19. When the scanning of the document is completed, exposure lamp 19 goes off, and first carriage 89 returns to its home position.

Figure 5:
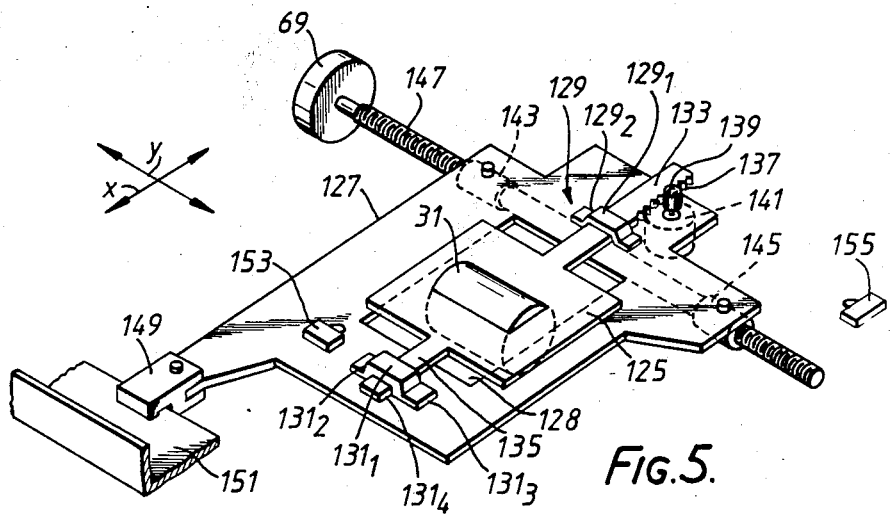
FIG. 5 is a perspective view of a moving mechanism for moving a magnification changing lens block used in the embodiment.

FIG. 5 shows a moving mechanism of magnification changing lens block 31. A first moving base 125 is slidably mounted on a second moving base 127. Magnification changing lens block 31, which is fixed to first moving base 125, is positioned in an aperture 128 provided at second moving base 127. Supporting members 129 and 131 which are individually positioned on opposite sides of aperture 128 are fixed to the surface of second moving base 127. Each supporting member 129 and 131 has a base portion $129_1$ and $131_1$, a pair of legs $129_2$ and $131_2$ perpendicularly projected from both ends thereof and a pair of pedestal portions $129_3$ and $131_3$ which are outwardly projected from each end of legs $129_2$ and $131_2$, respectively. Thus, a pair of pedestal portions $129_3$ and $131_3$ are fixed to second moving base 127. A guide aperture $129_4$ and $131_4$ is, therefore, defined by each base portion $129_1$ and $131_1$, a pair of legs $129_2$ and $131_2$ and the surface of second moving base 127. A pair of arm members 133 and 135 project from opposite sides of first moving base 125 respectively in the direction perpendicular to the light path of the mirror members described above. These arm members 133 and 135 are movably inserted into individual guide apertures $129_4$ and $131_4$. A rack 137 is formed on the side surface of arm member 133. A pinion 139 which is driven by a motor 141 fixed to second moving base 127 is operably engaged with rack 137 of arm member 133. Therefore, the movement of first moving base 125 is caused by the operation of rack 137 and pinion 139. A pair of bushings 143 and 145, with individual spiral grooves (not shown) on the inner surfaces thereof, are fixed in axial alignment to one side of the rear surface of second moving base 127 along the direction parallel to the light path of the mirror members. A bar-shaped lead screw 147, one end of which is connected to magnification changing motor 69, is formed with a spiral groove on its outer surface. Lead screw 147 is threaded onto bushings 143 and 145. Therefore, movement of second moving base 127 is caused by magnification changing motor 69 through leadscrew 147 and bushing pair 143 and 145 when the magnification rate is changed. At this time, a guide member 149 which is fixed to the other end of second moving base 127 keeps in contact with a guide rail 151 fixed to body 3 (not shown), so that second moving base 127 is guided by guide member 149 and guide rail 151. A microswitch 153 which is provided on second moving base 127 detects an original position of first moving base 125 when first moving base 125 is in contact therewith. While a microswitch 155 which is fixed to body 3 (not shown) detects an original position of second moving base 127 when second moving base 127 is in contact therewith.

The relationship between the operation of magnification changing lens block 31 and the document image formed on photosensitive drum 27 will be described by reference to FIGS. 6(*a*) and 6(*b*).

Optical formulas of this system are expressed as follows:

$$1/f = 1/ya + 1/yb$$

$$K = yb/ya$$

where f is the focal length of magnification changing lens block 31, ya is the optical length (first optical length) between document table 1 and magnification changing lens block 31, yb is the optical length (second optical length) between magnification changing lens block 31 and photosensitive drum 27 and K is a magnification rate. It can be understood from the formulas described above, when the magnification rate is changed, since the focal length f is constant, it is necessary to change first or second optical length ya or yb as well as a total optical length yc (ya+yb) in order to properly position magnification changing lens block 31. First and second optical lengths ya and yb can be changed by moving magnification changing lens block 31 along the optical path of the mirror elements. That is, when magnification changing motor 69 rotates, second moving base 127 and lens block 31 is moved. As a result that first and second optical lengths ya and yb is changed.

Figure 6A:
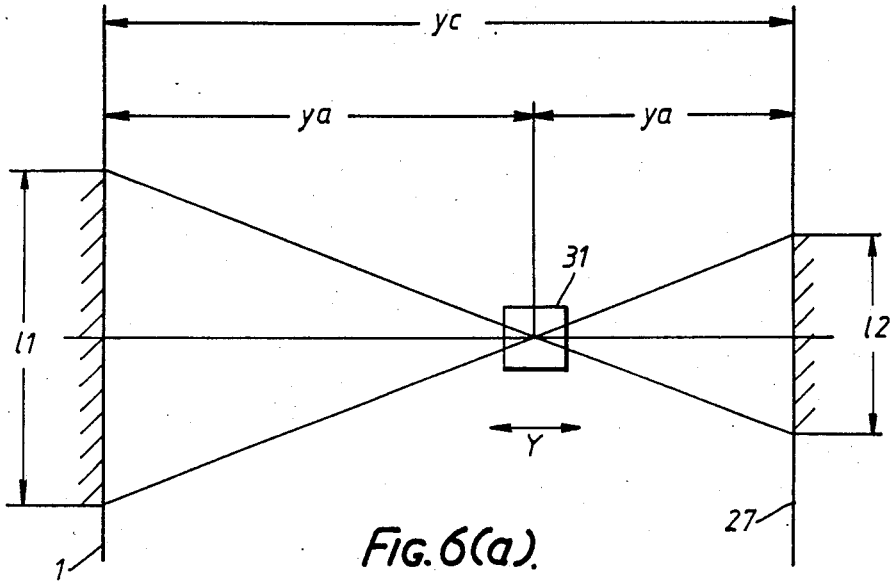
FIGS. 6(*a*) and 6(*b*) views illustrating how a document image is moved by the moving mechanism shown in FIG. 5.
Figure 6B:
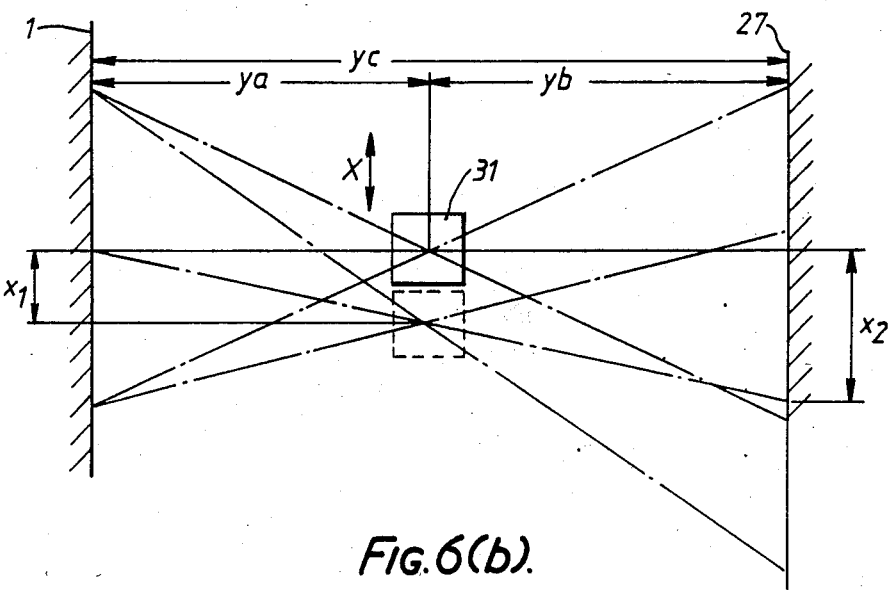

As shown in FIG. 6(*b*), the movement of the document image formed on photosensitive drum 27 is caused by moving first moving base 125 where magnification changing lens block 31 is mounted.

A moving amount ($X_2$) of the document image formed on photosensitive drum 27 is expressed as follows:

when individual distances among document table 1, magnification changing lens block 31 and photosensitive drum 27 are constant, $$X_2 = X_1(1+K)$$

When magnification rate is 1, $$X_2 = 2\,x_1$$

where $x_1$ is a moving amount of magnification changing lens block 31 in the direction x perpendicular to the light path of mirror members.

Figure 7:
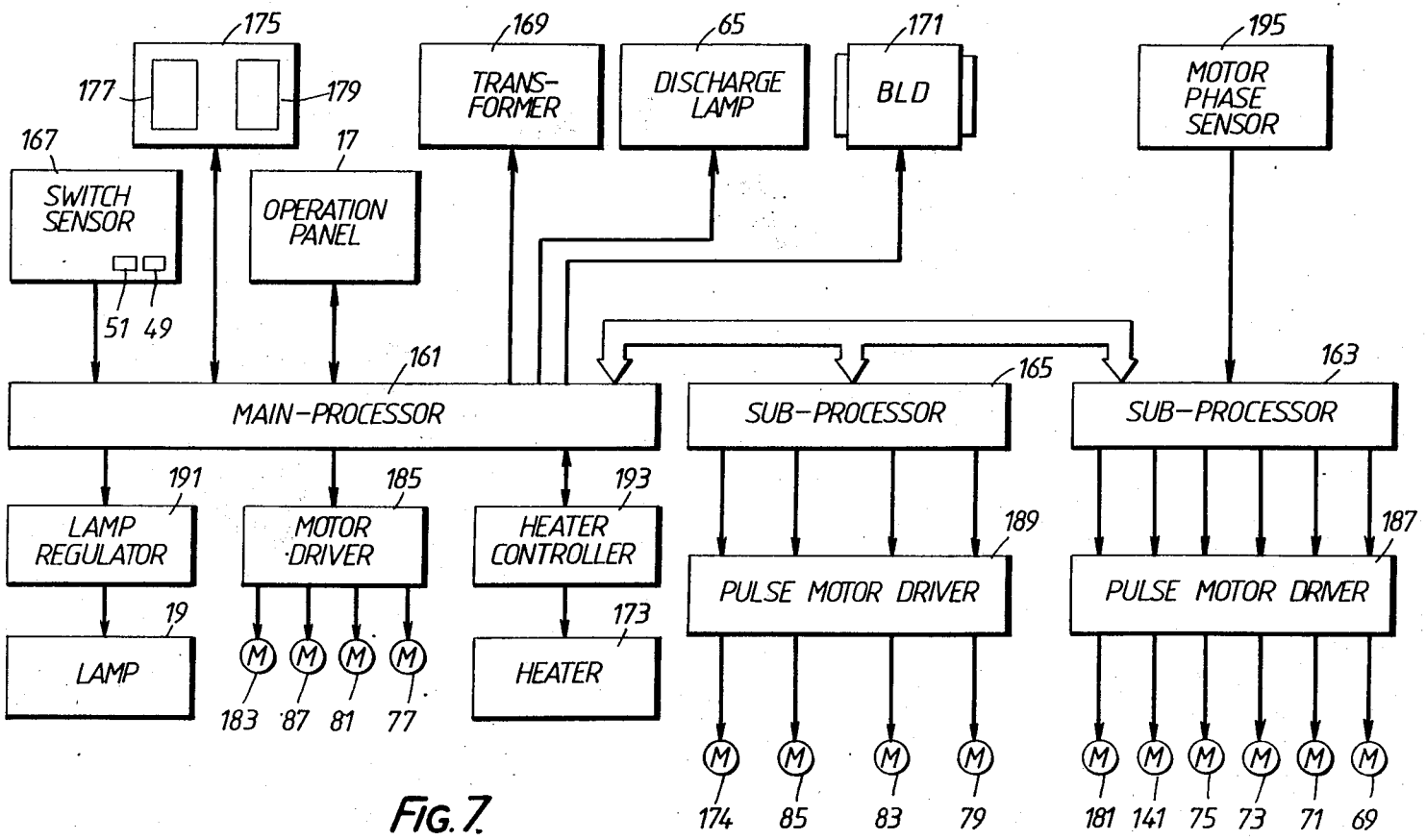
FIG. 7 is a control circuit diagram illustrating the electrical layout as a whole of this invention.

FIG. 7 shows an entire control circuit. The principal components of this circuit are a main processor 161 and first and second sub-processors 163 and 165 cooperating in a well known conventional manner. Main processor 161 executes the copying operation, by detecting the inputs from control panel 17 and various input components 167 e.g. cassette size sensors 49 and 51, and by controlling a high voltage transformer 169 (which energizes various chargers), discharge lamp 65, a blade solenoid 171 of cleaner 63, heater 173 of fixing roller pairs 55, exposure lamp 19 and motors 69, 71, 73, 75, 77, 79, 81, 83, 85, 87, 141 and 174 (which moves a pair of indicators indicating a copy-available range).

Main processor 161 also carries out the regulating operation described above, by detecting the offset amount of copy paper fed from upper or lower paper cassettes 11 or 13 by using an optical detection unit 175 described later, and by adjusting the position at which the document image is formed on the copy paper. Optical detection unit 175 includes a light-emitting element 177, optical sensor 179 and pulse motor 181. A toner motor 183 for feeding toner to developer 35 and motors 77, 81 and 87 are controlled by main processor 161 through a motor driver 185. Motors 69, 71, 73, 75, 141 and 181 are controlled by first sub-processor 163 through a pulse motor driver 187. Furthermore, motors 79, 83, 85 and 174 are controlled by second sub-processor 165 through a pulse motor driver 189. Exposure lamp 19 is controlled by main processor 161 through a lamp regulator 191. Heater 173 is controlled by main processor 161 through a heater controller 193. "Run" and "stop" commands for various motors are sent from main processor 161 to first and second sub-processors 163 and 165. While, from first and second sub-processors 163 and 165 to main processor 161, each status signal indicating a "run" or "stop" state of respective motors is sent. Position information from a motor phase sensor 195, which detects each initial position of motors 69, 71, 73, 75, 141 and 181, is sent to first sub-processor 163.

The constitution and detecting operation of optical detection unit 175 which detects the offset of copy paper fed from paper cassettes 11 and 13 will be described with reference to FIGS. 8(*a*), 8(*b*) and 8(*c*). Optical detection unit 175 is disposed between aligning roller-pair 41 and photosensitive drum 27 as shown in FIG. 2.

The body 196 of optical detection unit 175 is composed of a support portion 197 and a pair of arm portions 199 and 201 which project from opposite ends of support portion 197 in the direction perpendicular to support portion 197. Lightemitting element 177 and optical sensor 179, e.g. a plurality of photosensitive-diodes 203*a*, 203*b*, 203*c* and 203*d*, are attached to arm portions 199 and 201. Arm 201 is movably arranged on a guide shaft 205 which extends along aligning roller pair 41. Arm 201 is also fixed to a timing belt 207 disposed along aligning roller pair 41. Timing belt 207 extends between pulleys 209 and 211. One of the pulleys 209 is driven by pulse motor 181. Therefore, optical detection unit 175 is moved along guide shaft 205, when pulse motor 181 rotates. The original position of optical detection unit 175 is detected by a microswitch 213 which is disposed near guide shaft 205. It should be noted that a distance yp between guide shaft 205 and aligning roller pair 41 is practically very narrow, although the distance yp is wide displayed in FIG. 8(*a*).

Figure 8A:
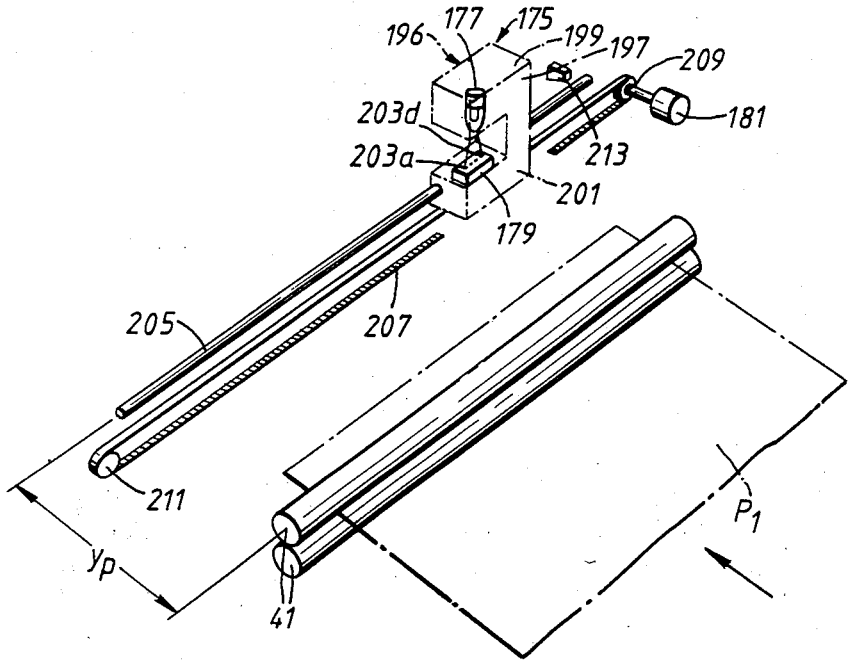
FIG. 8(*a*) is a perspective view illustrating an optical detection unit used in the embodiment.
Figure 8B:
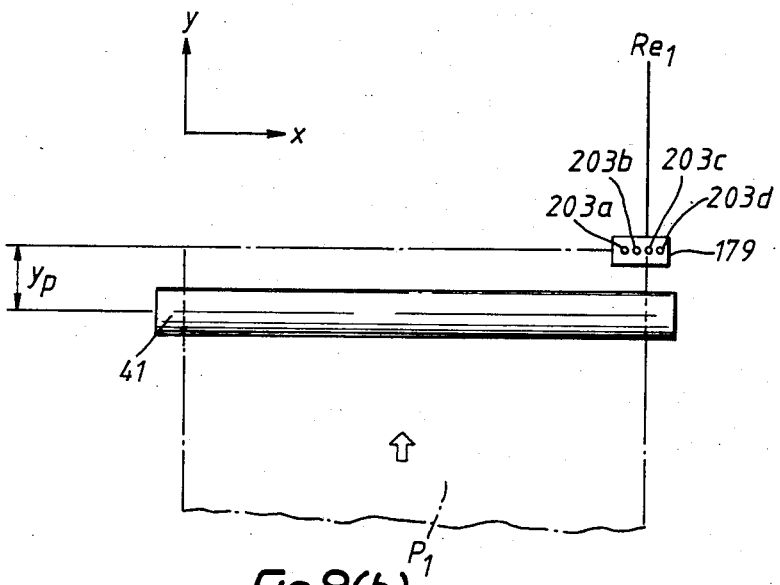
Figure 8C:
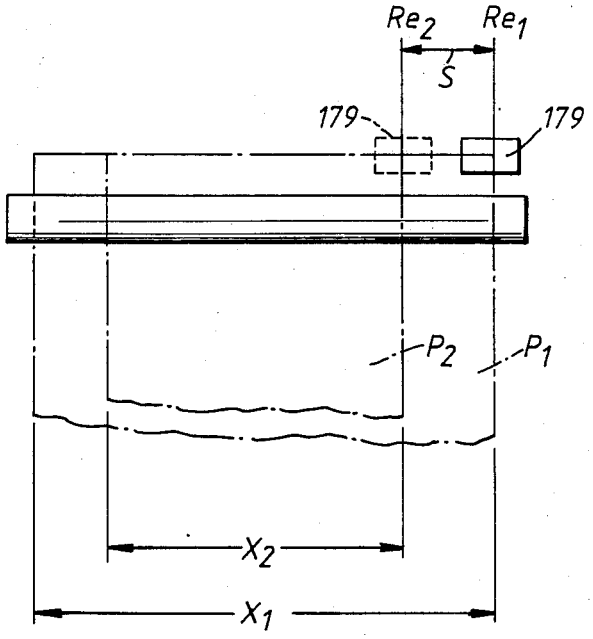
Figure 9:
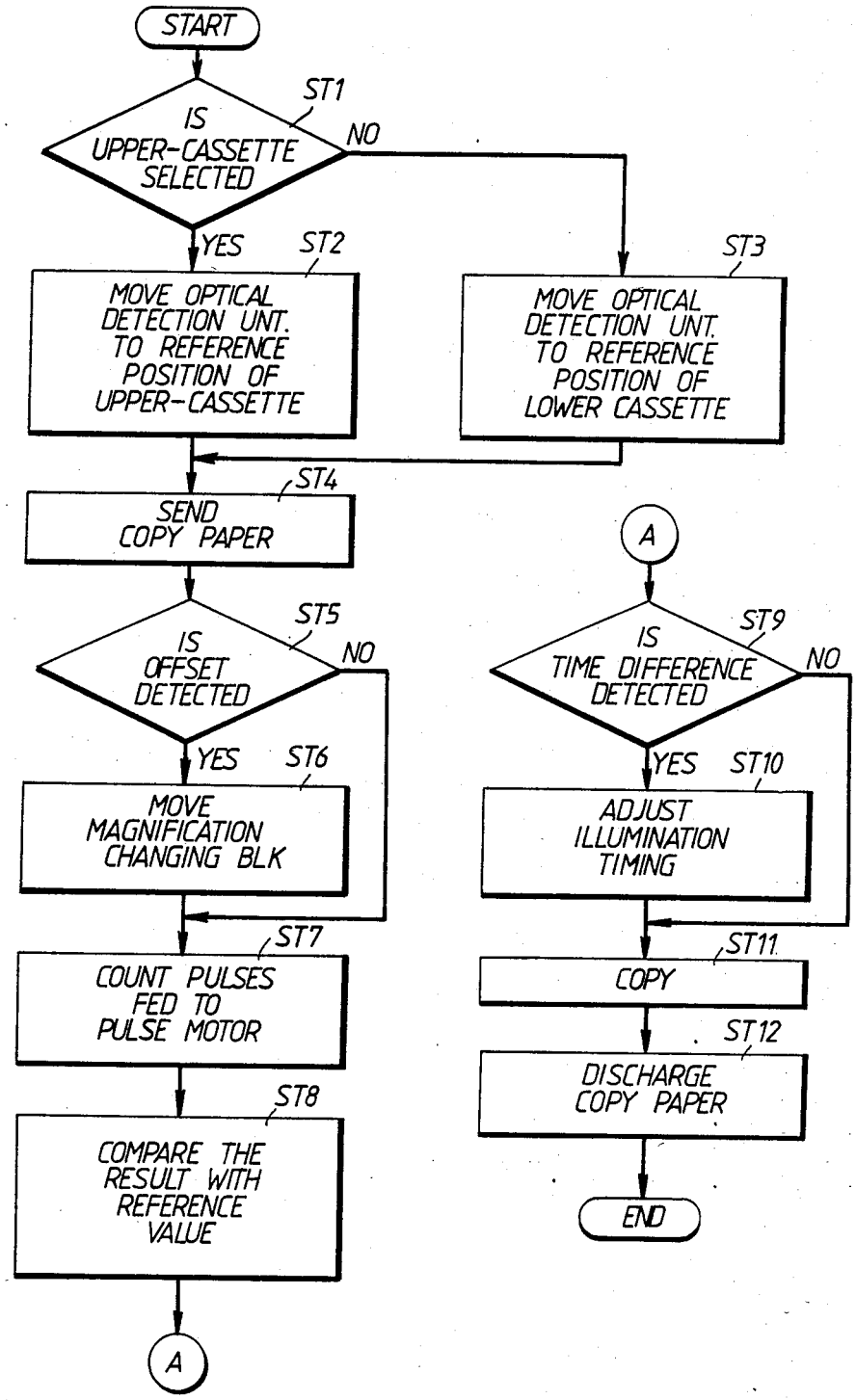
FIG. 9 is a flow chart showing a copying operation of the embodiment.

When the "COPY" key (not shown) is operated, the operation as shown in FIG. 9 is carried out in main processor 161. At decision step ST1, processor 161 determines whether upper cassette 11 or lower cassette 13 is identified on the basis of the operation of a "CASSETTE SELECTION" key (not shown) in operation panel 17. The YES path is taken if upper cassette 11 is selected, while the NO path is taken if lower cassette 13 is selected. At step ST2 or ST3, optical detection unit 175 is moved to each reference position corresponding with the size of each copy paper selected. As can be seen in FIG. 8(*c*), when copy paper is changed from paper $P_1$ to paper $P_2$ by operating a cassette selection key (not shown), optical detection unit 175 is moved from the reference position ($Re_1$) of paper $P_1$ to the reference position ($Re_2$) of paper $P_2$. The moving distance (S) of optical detection unit 175 is as follows:

$$S=(X_1-x_2)/2$$

where $X_1$ is the width of copy paper $P_1$ and $X_2$ is the width of copy paper $P_2$.

As shown in FIG. 8(*b*), optical detection unit 175 is moved so that the appropriate reference position is centered between photosensitive diodes 203*b* and 203*c*. Papers fed from each cassette are so designed that the center of the elongated direction thereof coincides with the center of aligning roller pair 41 when it is fed to aligning roller pair 41.

At a step ST5 in FIG. 9, when no offset of copy paper fed from the selected paper cassette has occurred, optical coupling between lightemitting element 177 and photosensitive diodes 203*a* and 203*b* is interrupted by the copy paper, so that photosensitive diodes 203*c* and 203*d* output their signals. However, when an offset of copy paper $P_1$ has occurred, the number of signals optical sensor 179 outputs is varied. If only photosensitive diode 203*d* outputs a signal, the offset-direction of the copy paper is to the right, while if photosensitive diodes 203*b*, 203*c* and 203*d* output individual signals, the offset-direction of copy paper $P_1$ is to the left. In both cases described above, the value of distance (D) between photosensitive diodes adjacent to one another is looked upon as the offset amount of the copy paper.

The value of a maximum error of the measurement mentioned above is only D/2, therefore, the drawback of the conventional copying machines can be greatly improved. According to this detection result, main processor 161 controls motor 141, as shown in FIG. 5, through first subprocessor 163 and pulse-motor driver 187 at a step ST6. As a result, the document image formed on the copy paper can be moved by moving magnification changing lens block 31 arranged on first moving base 125 through pinion 139 and rack 137.

Then, a time difference of the copy paper in the feeding direction (Y) of the copy paper is detected at steps ST7–ST9. The time difference of the copy paper in the feeding direction (Y) is caused by the nature of the copy paper, e.g. the thickness or smoothness, etc., of the paper. The rotation of aligning roller pair 41 and a scanning operation by exposure lamp 19 and first and second carriages 89 and 91 are mechanically operated in a prescribed relationship. If the feeding timing of copy paper by aligning roller pair 41 differs from a desired value, the image of the original document cannot be formed at the correct position on the copy paper along the feeding direction (Y). At steps ST7–ST9, the time difference in feeding the copy paper can be detected by detecting the period of time from the commencement of rotation of aligning roller pair 41 until the detection of the signal output from optical sensor 175.

Thus, a value of the time difference is determined by counting at step ST7 a number of pulses fed to pulse motor 83, which rotates aligning roller pair 41. Counting continues until the copy paper sent by aligning roller pair 41 is detected by optical detection unit 175, and the value of the resulting count is compared with a reference value in main processor 161 at step ST8. In other words, a discrepancy between an actual feeding time interval of the copy paper, transferred from aligning roller pair 41 to optical detection unit 175, and a prescribed feeding time interval is determined. Step ST9 determines whether a time difference has been detected.

If a time difference is detected, main processor 161, at step ST10, changes the timing of the lighting of exposure lamp 19 through lamp regulator 191, and the operation of pulse motor 73 through first sub-processor 163, that is, the beginning of the scanning operation for the original document.

Then, the copying operation is executed at a step ST11. After that, the copy paper where the document image of the original document is fixed at the appropriate position thereon is discharged from copying machine 3 at step ST12.

Figure 10:
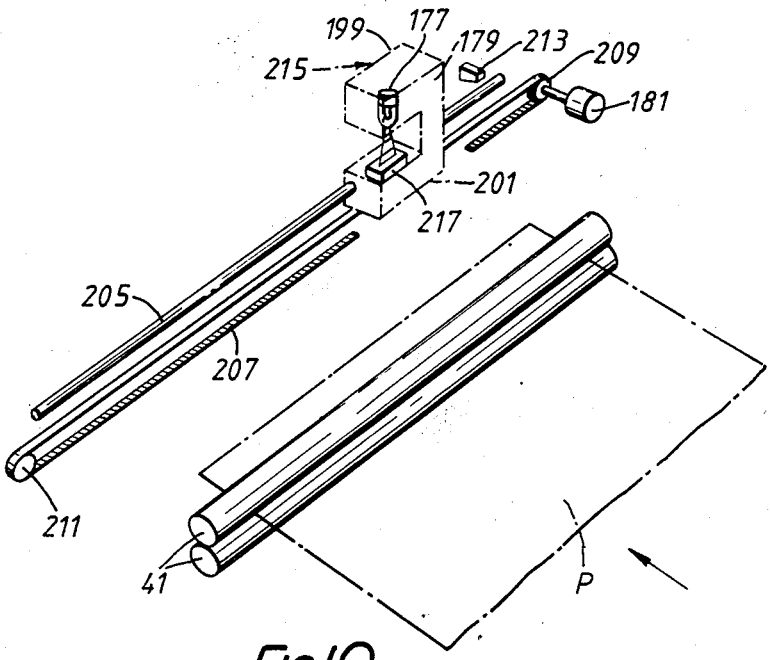
FIG. 10 is a perspective view illustrating a second embodiment of the present invention.

FIG. 10 shows a second embodiment of the present invention. In this embodiment, accuracy of the detection of the offset amount of copy paper by an optical detection unit 215 is improved. A line sensor 217, in which a line type CCD (charge-coupled device) is arranged, is used instead of photosensitive diodes 203*a* to 203*d* in the previous embodiment. Therefore, as compared with the previous embodiment, accurate detection of the offset amount of copy paper is carried out. The detecting operation of optical detection unit 215 in this embodiment is similar to that of optical detection unit 175 in the previous embodiment, therefore, detailed descriptions thereof are not described.

Figure 11A:
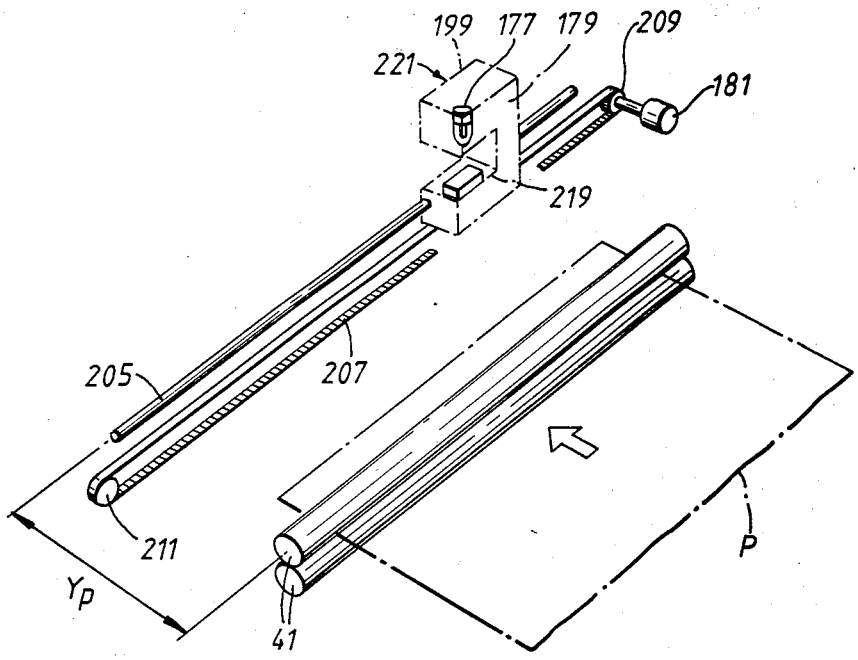
FIG. 11(*a*) is a perspective view illustrating a third embodiment of the present invention.
Figure 11B:
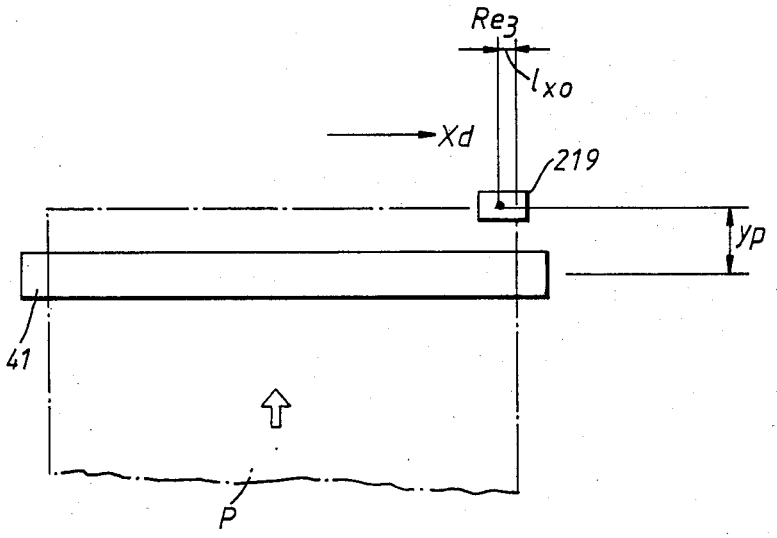
Figure 11C:
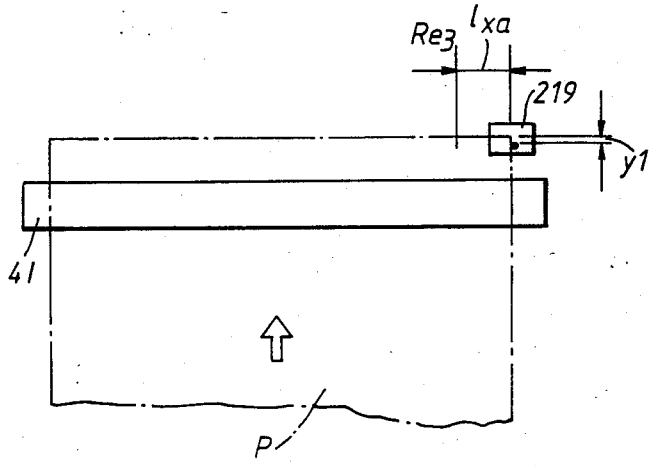

FIGS. 11(*a*), 11(*b*) and 11(*c*) show a third embodiment of this invention. In this third embodiment, only one photosensitive diode 219 is used in an optical detection unit 221. As shown in FIG. 11(*b*), when a size of copy paper is determined by selecting either cassette 11 or cassette 13, photosensitive diode 219 of optical detection unit 221 is moved to a reference position $Re_3$. It is designed that the distance $1x_0$ of the reference position $Re_3$ from the edge of a copy paper which is not offset is larger than the maximum offset amount of the copy paper selected. When the copy paper sent from aligning roller pair 41 is detected by optical detection unit 221, optical detection unit 221 is moved toward the edge of the copy paper by motor 181, and detects the side edge of the copy paper. At the same time, the distance $1x_a$ (see FIG. 11(*c*)) between the reference position $Re_3$ and the side edge of an actual copy paper, as detected by optical detection unit 221, is determined by main processor 161. Therefore, the offset amount 1x in the direction perpendicular to the feeding direction of copy paper is determined by main processor as follows:

$$1x = 1x_0 - 1x_a$$

The adjusting operation of the document image formed on the copy paper is the same as in the embodiments described above, therefore a detailed description thereof is not provided. Though the copy paper may be stopped when optical detection unit 221 detects the presence of the copy paper, it is more convenient for detecting the side edge of the copy paper to feed the copy paper by a small distance y1 as shown in FIG. 11(*c*) after optical detection unit 221 detects the presence of the copy paper.

According to the third embodiment of this embodiment, the offset amount of copy paper is accurately detected by the optical detection unit described above.

In summary, it will be seen that the present invention overcomes the disadvantages of the prior art and provides an improved image forming apparatus which can form a document image at an appropriate position on a copy paper corresponding to an original document Many changes and modifications in the above-described embodiments can be carried out without departing from the scope of the present invention. Therefore, appended claims should be construed to include all such modifications.

What is claimed is:

1. An image forming apparatus comprising:

detection means for detecting a presence of a copy paper and determining an offset amount of said copy paper from a prescribed position in a direction perpendicular to a feeding direction of said copy paper;

scan means for optically scanning an original document;

visible image forming means for forming a document image corresponding to said original document scanned by said scan means as a visible image on said copy paper; and image moving means for moving said visible image, in said direction perpendicular to a feeding direction of said copy paper, formed on said copy paper by said visible image forming means on the basis of said determination of said detection means.

2. The image forming apparatus according to claim 1 wherein said detection means comprises:

a body;

a pair of arms extending from said body; and an optical detection unit attached to said arms.

3. The image forming apparatus according to claim 2 wherein said optical detection unit includes a light-emitting element provided on one of said arms of said detection means and a photosensitive device provided at the other of said arms of said detection means, said copy paper passing between said light-emitting element and said photosensitive device.

4. The image forming apparatus according to claim 3 wherein said photosensitive device includes a photosensitive diode.

5. The image forming apparatus according to claim 3 wherein said photosensitive device includes a plurality of photosensitive diodes arranged in line.

6. The image forming apparatus according to claim 3 wherein said photosensitive device includes a line type charge-coupled device.

7. The image forming apparatus according to claim 2, further including means for moving said detection means in said direction perpendicular to the feeding direction of said copy paper.

8. The image forming apparatus according to claim 7, wherein said moving means comprises:

a pulse motor;

a pair of pulleys, at least one driven by said motor; and a timing belt, on which said detection means is fixed, wound around said pulleys.

9. The image forming apparatus according to claim 8, wherein said moving means further comprises a guide shaft extending along said direction perpendicular to the feeding direction of said copy paper to guide said detection means when said detection means is moved.

10. The image forming apparatus according to claim 1, wherein said image moving means comprises:

a first moving base; and a magnification changing lens block through which the document image is directed to said visible image forming means fixed to said first moving base.

11. The image forming apparatus according to claim 10 further including a second moving base on which said first moving base is slidably mounted.

12. The image forming apparatus according to claim 11, wherein said first moving base includes a pair of arms respectively projecting from the opposite sides thereof in said direction perpendicular to a feeding direction of said copy paper, one of said arms forming a rack, said image moving means also including a pinion and a pinion drive motor attached to said second moving base, said rack operably engaging said pinion so as to move said magnification changing lens.

13. The image forming apparatus according to claim 12, further comprising means for selecting a magnification rate and drive means for moving said second moving base in response to a selected magnification rate.

14. The image forming apparatus according to claim 13, wherein said drive means comprises:

a lead screw, disposed along said feeding direction of said copy paper;

a pulse motor driving said lead screw; and a pair of supporting elements, operably engaged with said lead screw, through which said second moving base is movable mounted on said lead screw.

15. The image forming apparatus according to claim 1, further comprising:

a roller drive pulse motor; and a pair of aligning rollers, driven by said roller drive pulse motor, to align said copy paper and feed it to said detection means.

16. The image forming apparatus according to claim 15, further comprising means for adjusting a position of said visible image, in said feeding direction of said copy paper, formed on said copy paper by said visible image forming means.

17. The image forming apparatus according to claim 16, wherein said adjusting means includes means for counting pulses fed to said roller drive pulse motor from the beginning of rotation of said roller drive pulse motor until said detection means detects a presence of said copy paper.

18. The image forming apparatus according to claim 17, wherein said adjusting means includes means for comparing a value from said counting means and a predetermined value and determining a difference between an actual feeding time interval of said copy paper transferred from said aligning roller pair to said detection means and a prescribed feeding time interval.

19. The image forming apparatus according to claim 18, wherein said adjusting means includes means for controlling a commencement timing of the operation of said scan means on the basis of the result of said comparing means.

20. An image forming apparatus comprising:

detection means for detecting a presence of a copy paper and determining an offset amount of said copy paper from a prescribed position in a direction perpendicular to a feeding direction of said copy paper;

scan means for optically scanning an original document;

visible image forming means for forming a document image corresponding to said original document scanned by said scan means as a visible image on said copy paper;

means for moving said visible image, in said direction perpendicular to said feeding direction of said copy paper, formed on said copy paper by said visible image forming means on the basis of said determination of said detection means;

a roller drive pulse motor;

a pair of aligning rollers driven by said roller drive pulse motor to align said copy paper and feed it to said detection means; and means for adjusting a position of said visible image, in said feeding direction of said copy paper, formed on said copy paper by said visible image forming means, said adjusting means including:

means for counting pulses fed to said roller drive pulse motor from the beginning of rotation of said roller drive pulse motor until said detection means detects a presence of said copy paper;

means for comparing a value from said counting means and a predetermined value and determining a difference between an actual feeding time interval of said copy paper transferred from said aligning roller pair to said detection means and a prescribed feeding time interval; and means for controlling a commencement timing of the operation of said scan means on the basis of the result of said comparing means.

* * * * *